United States Patent [19]

Stark

[11] 4,219,149

[45] Aug. 26, 1980

[54] CONTAINER CONSTRUCTION

[75] Inventor: Martin H. Stark, Saginaw, Mich.

[73] Assignee: Arrow Paper Products Company, Saginaw, Mich.

[21] Appl. No.: 927,466

[22] Filed: Jul. 24, 1978

[51] Int. Cl.[3] ..... B65D 5/02

[52] U.S. Cl. ..... 229/37 R; 229/23 R; 229/17 R

[58] Field of Search ..... 220/465, 466, 458, 410, 220/416, 418, 463; 229/16 A, 23 A, 23 B, 43, 8, 7, 37 R, 37 E

[56] References Cited

U.S. PATENT DOCUMENTS

| | | | |
|---|---|---|---|
| 1,861,206 | 5/1932 | Burgess | 229/8 X |
| 2,074,357 | 3/1937 | Bergstein | 229/7 R |
| 2,153,911 | 4/1939 | Benedetti | 229/7 R X |
| 2,361,408 | 10/1944 | Moore | 229/23 R X |
| 2,485,235 | 10/1949 | Graf | 93/36.8 |
| 2,710,134 | 6/1955 | Schroeder et al. | 229/37 R |
| 2,834,503 | 5/1958 | Knapp | 220/465 |
| 2,880,924 | 4/1959 | Moore | 229/37 E |
| 3,006,525 | 10/1961 | Herrman | 229/17 R |
| 3,236,436 | 2/1966 | Cheeley | 220/418 X |
| 3,355,081 | 11/1967 | Kachurchak | 220/418 X |
| 3,387,749 | 6/1968 | Godshalk et al. | 229/DIG. 11 |
| 4,053,102 | 10/1977 | Stark | 220/418 X |

*Primary Examiner*—Davis T. Moorhead
*Attorney, Agent, or Firm*—Learman & McCulloch

[57] ABSTRACT

A rectangular container construction is formed from a blank of paperboard material scored to form five flat panels each of which has a flap projecting from its opposite edges. The panels and flaps are folded to form a rectangular, hollow body, the two endmost panels overlying one another and forming the top of the body. The endmost panels are provided with openings in register with one another to permit access to the interior of the container. A band of pliable material overlies the juncture between each panel and its associated flaps, each band being formed of material that is sufficiently pliable to form a multiple layer of such material between adjacent flaps when the panels and flaps are folded to form the container body. Each panel preferably is formed from two superimposed blanks.

10 Claims, 9 Drawing Figures

CONTAINER CONSTRUCTION

BACKGROUND OF THE INVENTION

Containers formed of paperboard material are in wide usage for the packaging of dry materials such as chocolate, salt, cereals, and the like. Some of these materials, such as chocolate, are of such fine grain size that they are likely of sift through even very small openings of a container. In the packaging of such material in all-paperboard containers heretofore, it has been the practice to form cylindrical bodies to which end walls subsequently may be cemented so as to minimize the risk of the material's sifting out of the container. There are many disadvantages to the use of cylindrical containers, not the least of which is the volume taken up by such containers during their transport and storage prior to being filled. Further, the use of cylindrical containers results in the wasting of shelf space when such containers are placed on display in supermarkets and the like.

Containers for dry materials also have been manufactured in rectangular form. A rectangular container avoids the wasting of shelf space when such containers are placed on display. However, it has been the practice heretofore to form only the sides of such containers from paperboard material, the top and bottom walls of such containers being formed of metal or plastic materials crimped or otherwise secured to the side walls. The use of metal and plastic materials results in higher manufacturing costs as compared to an all-paperboard container, not only because of the higher expense of metal and plastic materials, but also because of the necessity of using machinery and manufacturing procedures that would not be required in the manufacture of an all-paperboard can. Further, pre-formed rectangular containers composed of paperboard sides and metal or plastic end closures do not solve the problem of wasted space in the transport and storage of empty containers.

SUMMARY OF THE INVENTION

A container constructed in accordance with the invention overcomes the disadvantages referred to above by providing a sift-proof, all-paperboard container of rectangular configuration which may be manufactured by conventional paperboard machinery and which can be transported and stored in flat condition until such time as it is to be filled. The improved container is formed from a pair of superimposed rectangular blanks of paperboard material, each of which is scored to form five flat panels adapted to form the front, back, bottom and top walls of the finished container. One of the blanks has flaps extending from each edge of each panel which may be folded to form the side walls of the container. The two endmost panels of each blanks are arranged in overlying relation to form the top wall of the container, such top wall thus constituting four thicknesses of paperboard material. Each of the panels forming the top wall of the container is provided with openings in register with one another to permit access to the interior of the container. Preferably, a band of pliable material overlies the juncture of each panel with its associated flaps, such band being formed of a material which is sufficiently pliable and resilient as to enable it to form multiple layers between adjacent flaps when the panels and the flaps are folded to form the container. Such multiple layers assure a sift-proof juncture between adjacent panels and flaps.

DESCRIPTION OF THE DRAWINGS

A container constructed in accordance with the invention is illustrated in the accompanying drawings, wherein.

Figure 1:
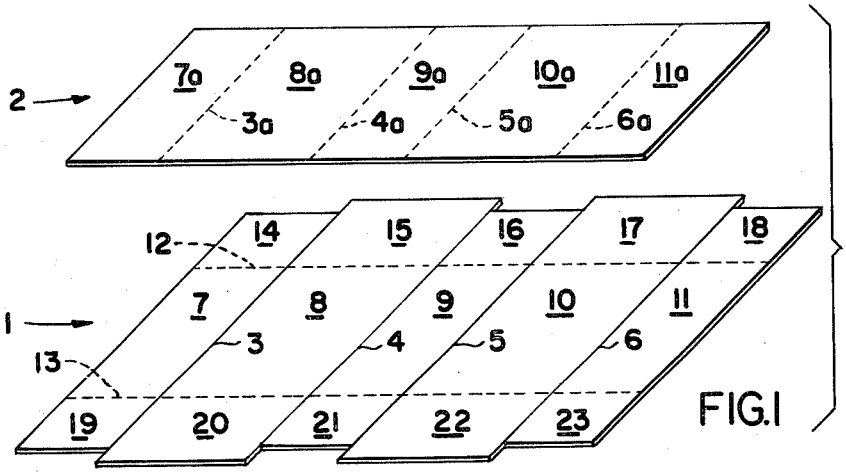
FIG. 1 is an exploded view illustrating a pair of scored paperboard blanks.

A container constructed in accordance with the disclosed embodiment of the invention is formed from two blanks 1 and 2 of paperboard material of a suitable kind such as kraft board. The blank 1 is scored transversely at intervals along parallel lines 3, 4, 5, and 6 to form five flat panels 7, 8, 9, 10, and 11 joined to one another. The panels 7, 9 and 11 are equal in width, and the panels 8 and 10 are of equal width. The blank 1 also is provided with a pair of parallel creases 12 and 13 at opposite ends of each panel to form flaps 14, 15, 16, 17, and 18 extending from one edge and in prolongation of the associated panels and similar flaps 19, 20, 21, 22, and 23 extend in prolongation of the opposite edges of the associated panels. The flaps 15, 17, 20, and 22 are of equal width and longer than the flaps 14, 16, 19 and 21, the latter being of equal length. The flaps 18 and 23 are of equal length, but are shorter than any other flap. Preferably, the length of each of the longer flaps corresponds to the width of the panels 7, 9, and 11.

The blank 2 has no flaps, but is provided with transverse scores 3*a*, 4*a*, 5*a*, and 6*a* which form panels 7*a*, 8*a*, 9*a*, 10*a*, and 11*a*. The length of the blank 2 corresponds to the length of the blank 1, but the width of blank 2 is less than that of the blank 1. The width of the blank 2 preferably corresponds substantially to the distance between the creases 12 and 13.

The blank 2 is adapted to be placed in overlying relation with the blank 1 and adhesively laminated to the latter with the score lines 3*a*–6*a* coinciding with the score lines 3–6, respectively. Each of the panels thus is formed of two thicknesses of paperboard material, but each of the flaps 14–23 is of single thickness.

Figure 3:
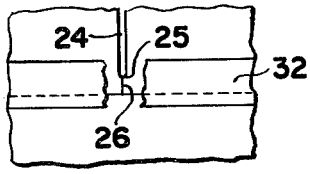
FIG. 3 is a greatly enlarged, plan view of a portion of the structure shown in FIG. 2.
Figure 4:
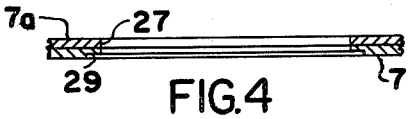
FIG. 4 is a sectional view taken on the line 4—4 of FIG. 2.
Figure 5:
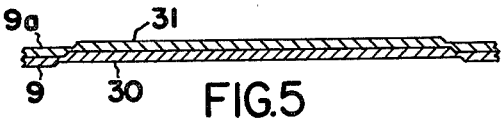
FIG. 5 is a sectional view taken on the line 5—5 of FIG. 2.

Each flap is separated from its adjacent flap by a slit 24. As is best shown in FIG. 3, each slit 24 has a portion extending inwardly from the free edges of the associated flaps and terminates adjacent the associated score line in a neck 25 provided with a cut score 26. A cut score is a slit which extends only partially through the paperboard material. The cut score enables adjacent flaps to be folded over one another without necessarily causing rupture of the material of the neck at the creases 12 and 13.

The scoring, creasing, slitting and cut scoring operations may be effected by suitable dies (not shown) in the forming of the blanks 1 and 2 as is well known in the art.

At the same time, each of the endmost panels 7, 7*a* and 11, 11*a* is provided with an elliptical or other shaped opening. The openings in the panels 7, 7*a* are represented by the reference character 27 and are of equal size. The openings in the panels 11, 11*a* are represented by the reference character 28 and also are of equal size. The openings 28, however, are slightly larger than the openings 27 for a purpose presently to be explained.

At the same time that the opening 27 is formed in the panel 7, that portion of the panel adjacent the opening is compressed by a suitable die (not shown) to provide a reduced thickness flange 29 about the periphery of the opening 27.

During the formation of the blanks 1 and 2, the panels 9, 9*a* are deformed by a suitable die (not shown) to provide an offset portion 30, 31 which will be in alignment with the openings 27 and 28 when the panels of the blanks are folded to form the container body.

Following the laminating of the blanks 1 and 2 to one another, a strip or band 32 of tough, pliable, and somewhat elastic material, such as stretchable polyester, polyethylene, and polyvinylchloride film, is placed in overlying relation with each of the blanks and along the juncture of the flaps with the associated panels. The bands 32 preferably have a peelable, pressure sensitive adhesive on one side so as to enable them to be adhered to the respective blanks.

Figure 6:
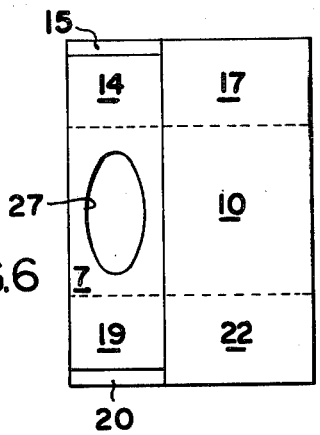
FIG. 6 is a plan view illustrating a procedural step in the formation of the container.
Figure 7:
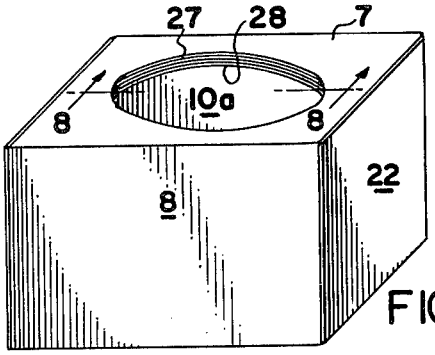
FIG. 7 is an isometric view of a completed container.
Figure 8:
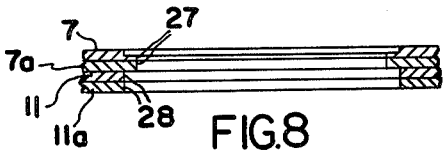
FIG. 8 is a sectional view taken on the line 8—8 of FIG. 7.
Figure 9:
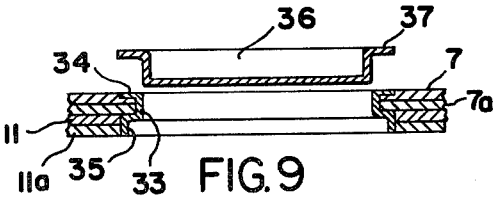
FIG. 9 is a view similar to FIG. 8 and illustrating a removable closure which may be used with the container.

Following placement of the bands 32, the panels of the superimposed blanks are folded in such manner as to enable the endmost panels 7, 7*a* and 11, 11*a* to be arranged in overlying relation. See FIG. 6. Preferably, the panels 7, 7*a* overlie the panels 11, 11*a*. The panels 7*a* and 11 then may be adhesively secured to one another. The panels and flaps then are so arranged that they are in flat condition for transport or storage.

Prior to filling the container, the flaps 16 and 21 are folded toward one another about the score lines 12 and 13, respectively, and the flaps 14 and 19 similarly are folded toward one another. Folding of the flaps 14 and 19 toward one another also will cause the flaps 18 and 23 to be folded toward one another. The flaps 15 and 20 then may be folded so that one overlies the other and the flaps 17 and 22 similarly may be folded so that one overlies the other. Adhesive (not shown) will be provided on the confronting faces of the several flaps so as to enable those flaps which engage one another to adhere firmly to one another.

When the panels and flaps are folded in the manner described, the top of the container will be formed by the panels 7, 7*a* and 11, 11*a*, the bottom of the container will be formed by the panels 9, 9*a*, the front wall of the container will be formed by the panels 8, 8*a*, and the rear wall will be formed by the panels 10, 10*a*. One sidewall of the container will be formed by the flaps 19, 20, 21, and 22, and the other side wall will be formed by the flaps 14, 15, 16, and 17. The top wall thus will be composed of four thicknesses of paperboard material. The bottom, the front, and the rear walls will be composed of two thicknesses of paperboard material and each side wall will be constituted over its entirety by at least two thicknesses of paperboard material. In addition, each side wall will include the flaps 14, 19, 16, 21, 18, and 23. This construction provides an extremely rugged structure which has the ability to withstand bulging due to slumping of the container's contents.

When the panels are folded in the manner indicated, the panel 11 underlies the panel 7*a*, but the openings 27 and 28 are in register. An annular metal or plastic liner 33 may be fitted into the openings, the liner having a lip 34 which seats in the depressed flange 29. The liner 33 also has a peripheral flange 35 which nests with that portion of the panel 7*a* which borders the opening 27. The liner 33 thus is trapped for retention in the panel openings and may receive a removable closure 36 having a peripheral flange 37 at its upper end. The flange 37 overlies the flange 34 of the liner and thus projects somewhat above the upper surface of the top wall of the container. The inwardly deformed portions 30, 31 of the bottom wall of the container are of such size as to accommodate the flange 37, thereby enabling containers to be stacked one atop another without an upper container's rocking.

Figure 2:
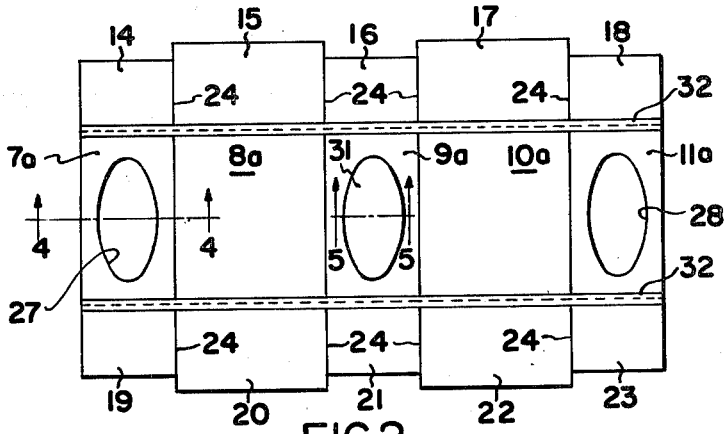
FIG. 2 is a top plan view illustrating the two blanks in superposed relation.

The construction of the slits 24, the neck 25, and the cut score 26, coupled with the adhesive securing of adjacent flaps to one another, is sufficient in most cases to form a sift-proof container. To ensure sift-proofness in the event the container is subjected to rough handling, it is preferred to make use of the bands 32. The manner in which the bands function can best be described by reference to FIG. 2. When the flap 19 is folded inwardly about the score line 13 so as to form a right angle with the panel 7*a*, that portion of the band 32 adjacent the left-hand edge of the flap 20 will be pulled upwardly and away from the latter. When the panels 7, 7*a* are folded inwardly about the score line 3, that edge of the flap 19 formed by the slit 24 will occupy a position alongside and parallel to the crease 13. When the flap 20 then is folded inwardly over the flap 19, that portion of the band which is adjacent the flap 19 will overlie the latter and become readhered to the flap 20. At the juncture of the flaps 19 and 20 adjacent the crease 13, therefore, there will be a double thickness of the band material, in triangular form, and there also will be a layer of band material extending from the inner surface of the flap 19 around the edge of the flap and over its outer surface. The same observations apply in respect to each of the other corners of the containers. The pliability of the band material enables it to be folded to form such multiple layers, and its tensile strength prevents tearing of the band.

This disclosure is intended to be representative of the preferred embodiment of the invention, rather than definitive thereof. The invention is defined in the claims.

I claim:

1. A container construction formed from a flat blank of material scored to form five parallel panels joined to one another adjacent sides, each of said panels having at each end thereof a flap extending in prolongation of such panel, each of said panels being creased at its juncture with the associated flaps and adjacent flaps being separated from one another by a slit, whereby said panels and said flaps may be folded inwardly relatively to one another to form a hollow body with the flaps at corresponding ends of said panels overlying one another, and a flat band of pliable material of uniform width overlying the juncture between said panels and each of the associated flaps and that portion of each slit adjacent said panels, said band being separably adhered to said panels and said flaps, the material from which said bands are formed being sufficiently pliable to extend without rupturing from beneath an underlying flap over the next adjacent overlying flap to form a multiple layer of such material between said underlying and next adjacent overlying flaps when said panels and said flaps are folded inwardly to form said body.

2. A construction according to claim 1 including a second blank of material overlying the first-mentioned blank and being correspondingly scored to form corresponding panels.

3. A construction according to claim 2 wherein said second blank is coextensive in length with said first-mentioned blank.

4. A construction according to claim 3 wherein the panels of said second blank terminate at their opposite edges short of the juncture of said flaps and the panels of said first-mentioned blank.

5. A construction according to claim 1 wherein each of the endmost panels of said blank has an opening therein, said openings being in register with one another when said panels and flaps are folded to form said body.

6. A construction according to claim 5 wherein the panel opposite said endmost panels have a portion thereof deformed inwardly of said body, said deformed portion being in alignment with said openings.

7. A container construction comprising first and second blanks of material each of which is scored transversely thereof to form five panels joined to one another along adjacent sides, alternate ones of said panels being of substantially uniform area, means securing said blanks to one another in overlying relation, one of said blanks having flaps extending from opposite edges of each of its panels, each of said flaps being creased at its juncture with the associated panel and each of said flaps being separated from its adjacent flap by a slit, whereby said panels and flaps may be folded inwardly relatively to one another to form a hollow body with the other of said blanks being at the inside of said body, the endmost panels of said first and second blanks being in overlying relation and forming a wall of four thicknesses of said material and said flaps at corresponding ends of said one of said blanks overlying one another and forming a wall of four thicknesses of said material when said panels and flaps are folded to form said body, each of said endmost panels having an opening therein in register with one another to provide access through said wall to the interior of said body.

8. A construction according to claim 7 including a flat band of pliable material of uniform width overlying the creases between said panels and said flaps and that portion of each slit adjacent said panels, the material from which said bands are formed being sufficiently pliable to form without rupturing a multiple layer of such material between two adjacent flaps when said panels and said flaps are folded inwardly to form said body.

9. A construction according to claim 7 where at least one of said endmost panels is depressed around the periphery of the opening therein.

10. A construction according to claim 7 wherein the panel opposite said endmost panels has a portion thereof deformed inwardly of said body, said deformed portion being in alignment with said openings.

* * * * *